US010932569B2

(12) United States Patent
Held

(10) Patent No.: US 10,932,569 B2
(45) Date of Patent: Mar. 2, 2021

(54) DRAWER COMPRISING A BASE PANEL, TWO LATERAL WALLS, A REAR WALL AND A SCREEN

(71) Applicant: FORM ORANGE PRODUKTENTWICKLUNG, Hard (AT)

(72) Inventor: Wolfgang Held, Hard (AT)

(73) Assignee: FORM ORANGE PRODUKTENTWICKLUNG, Hard (AT)

( * ) Notice: Subject to any disclaimer, the term of this patent is extended or adjusted under 35 U.S.C. 154(b) by 0 days.

(21) Appl. No.: 15/737,751

(22) PCT Filed: Jun. 30, 2016

(86) PCT No.: PCT/EP2016/065419
§ 371 (c)(1),
(2) Date: Dec. 18, 2017

(87) PCT Pub. No.: WO2017/001620
PCT Pub. Date: Jan. 5, 2017

(65) Prior Publication Data

US 2018/0206636 A1 Jul. 26, 2018

(30) Foreign Application Priority Data

Jul. 1, 2015 (DE) ..... 10 2015 110 560.8

(51) Int. Cl.
*A47B 88/00* (2017.01)
*A47B 88/90* (2017.01)
*A47B 88/956* (2017.01)

(52) U.S. Cl.
CPC ..... *A47B 88/941* (2017.01); *A47B 88/956* (2017.01); *A47B 2210/02* (2013.01); *A47B 2210/094* (2013.01); *A47B 2210/097* (2013.01)

(58) Field of Classification Search
CPC ..... A47B 2088/902; A47B 2088/941; A47B 2088/944; A47B 2088/95;
(Continued)

(56) References Cited

U.S. PATENT DOCUMENTS 3,687,512 A * 8/1972 Alston ..... F16B 12/24 312/348.2
4,128,284 A * 12/1978 King ..... A47B 88/941 312/263
(Continued)

FOREIGN PATENT DOCUMENTS

AT 505432 * 1/2009
AT 511066 * 9/2012
(Continued)

*Primary Examiner* — Janet M Wilkens
(74) *Attorney, Agent, or Firm* — John Alumit

(57) ABSTRACT

A drawer including a bottom panel, two side walls, a back wall and a facing. The bottom panel, the side walls and the back wall being of sheet metal. A wood facing connects to the sheet-metal parts. The side walls and the back wall, in the vicinity of the lower edge, have an inner groove or a support for receiving and supporting the bottom panel. The facing has two fitting parts on its back side, which are connectable to receiving fitting parts inserted into the face ends, oriented toward one another, of the side walls. The ends of the side walls oriented toward the back wall have fitting parts, which are provided with detent hooks and can be latched in detent receptacles on the back wall.

8 Claims, 7 Drawing Sheets

(58) Field of Classification Search
CPC ..... A47B 2088/951; A47B 2088/953; A47B 2088/954; A47B 2088/955; A47B 2088/956; A47B 88/90
USPC ..... 312/330.1, 334.6, 348.1–348.4
See application file for complete search history.

(56) References Cited

U.S. PATENT DOCUMENTS 4,802,716 A * 2/1989 Rock ..... A47B 88/941 312/330.1
5,540,515 A * 7/1996 Rock ..... A47B 88/95 292/341.17
5,588,730 A * 12/1996 Rock ..... A47B 88/941 312/263
6,871,921 B2 * 3/2005 Ernst ..... A47B 88/90 220/529
8,998,356 B2 * 4/2015 Gasser ..... F16B 12/26 312/348.2
9,028,019 B2 * 5/2015 Holzapfel ..... A47B 88/95 312/348.4
2003/0038565 A1 * 2/2003 Walla ..... A47B 96/06 312/184
2004/0000852 A1 * 1/2004 Lam Harn ..... A47B 88/956 312/348.4
2006/0049730 A1 * 3/2006 Sutterlutti ..... A47B 88/00 312/330.1
2014/0072366 A1 * 3/2014 Holzapfel ..... F16B 12/02 403/326
2014/0077677 A1 * 3/2014 Holzapfel ..... A47B 88/0055 312/348.4
2014/0167586 A1 * 6/2014 Schallert ..... A47B 88/941 312/330.1
2014/0167588 A1 * 6/2014 Park ..... A47B 88/14 312/334.6
2014/0252936 A1 * 9/2014 Holzapfel ..... A47B 88/95 312/348.4
2014/0312756 A1 * 10/2014 Ng ..... A47B 88/956 312/334.5
2016/0316910 A1 * 11/2016 Karu ..... A47B 88/95
2016/0360884 A1 * 12/2016 Karu ..... A47B 88/941

FOREIGN PATENT DOCUMENTS

AT 516838 * 9/2016
DE 102008035293 * 2/2010
DE 102014011090 * 2/2016
DE 102014113954 * 3/2016
DE 202016102168 * 7/2017
EP 722680 * 7/1996
EP 1157636 * 11/2001
EP 3167759 * 5/2017
GB 2193430 * 2/1988
WO 2008028811 * 3/2008
WO 2012068604 * 5/2012
WO 2013040614 * 3/2013
WO 2013075152 * 5/2013

* cited by examiner

DRAWER COMPRISING A BASE PANEL, TWO LATERAL WALLS, A REAR WALL AND A SCREEN

BACKGROUND

The invention relates to a drawer having a bottom panel, two side walls, a back wall and a facing.

In the known drawers, all these components, that is, the bottom panel, the two side walls, the back wall and the facing, are of wood. All these components, in the prior art, are glued to one another to form a solid part, which is a drawer. It is also known to provide these components with structural fittings adapted to one another and to compose the drawer with them.

It is the object of the invention to develop a drawer which is easy to assemble with its components, but in which the facing can be connected to a prefabricated unit and disconnected from it again afterward.

SUMMARY

This stated object is attained with the features of claim 6.

According to the invention, the bottom panel, the two side walls and the back wall are of sheet metal, and the facing is of wood, which is connectable to the sheet-metal parts of the drawer. The side walls and the back wall, in the vicinity of the lower edge, have an inner groove or support for the bottom panel. The wooden facing has two fitting parts on its back side that are connectable to receiving fitting parts inserted into the face ends, oriented toward one another, of the side walls. The ends of the side walls, which ends are oriented toward the back wall, have fitting parts which are provided with detent hooks and can be latched in detent receptacles of the back wall. In this way, the bottom panel, the two side walls and the back wall, all of sheet metal, can easily be connected together to make a prefabricated unit, onto which then a facing of wood can easily be attached and detached again.

To enable the side walls to easily receive the fitting parts required for assembling the prefabricated unit, an advantageous refinement of the drawer provides that the side walls are each composed of two side parts, and the fitting parts are inserted between the two side parts on the face end oriented toward the facing and are connectable to the fitting parts on the back side of the facing, and the inner side part of the double-layered side wall forms a support or receiving groove for the bottom panel.

In a further embodiment of the drawer, it is provided that the fitting part connected to the end of the side walls and to the back wall protrudes with detent hooks from the inside of the inner side parts and is connectable and latchable to detent receptacles of the back wall.

DRAWINGS

The drawer of the invention will be described in further detail in terms of exemplary embodiments shown in the accompanying drawings. In the drawings:

FIG. 1, in a perspective view toward the back side, shows the assembled drawer;

FIG. 2 in perspective shows the drawer of FIG. 1, seen from the facing;

DETAILED DESCRIPTION

Figure 1:
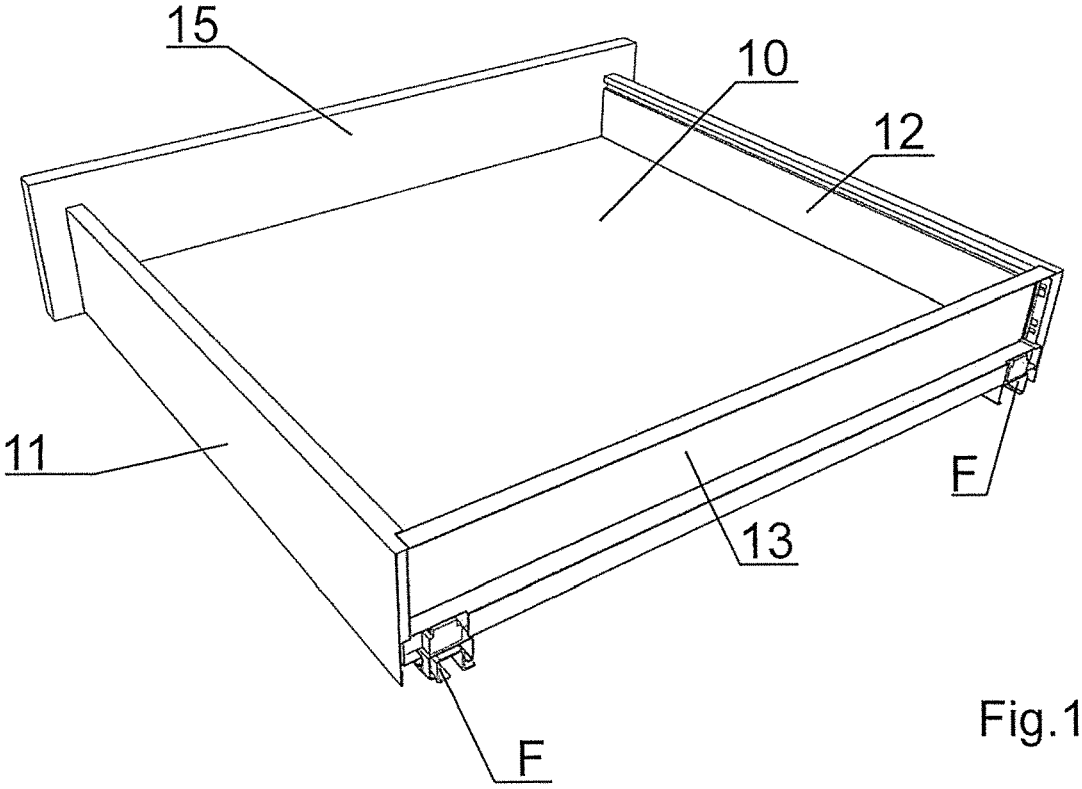
Figure 2:
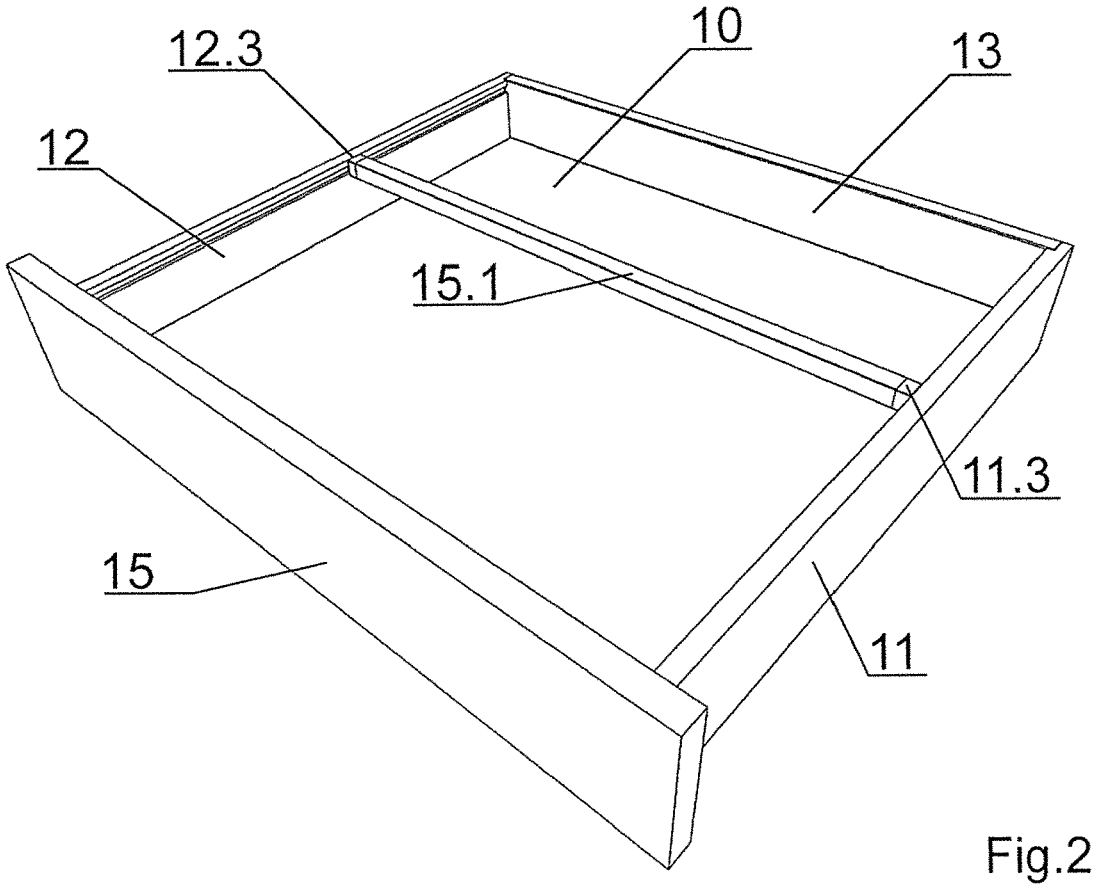

FIGS. 1 and 2 show a drawer comprising a bottom panel 10, two side walls 11 and 12, and a back wall 13 of sheet metal. These components made of sheet metal can be pre-mounted via fitting parts as a prefabricated unit and then provided with a facing 15 of wood, which can be attached afterward to the prefabricated sheet-metal unit comprising the bottom panel 10, two side walls 11 and 12, and the back wall 13, and later detached again. FIGS. 1 and 2 show the finished drawer in two perspective positions seen toward the back wall 13 and toward the facing 15. It is also possible for only the side walls 11 and 12 to be of sheet metal and to comprise two parts 11.1, 11.2 and 12.1, 12.2, respectively.

As FIG. 2 shows, the top of the side walls 11 and 12 can be provided with receiving grooves 17 or 18, which receive a divider 15.1 that is oriented parallel to the facing of the drawer.

Figure 3:
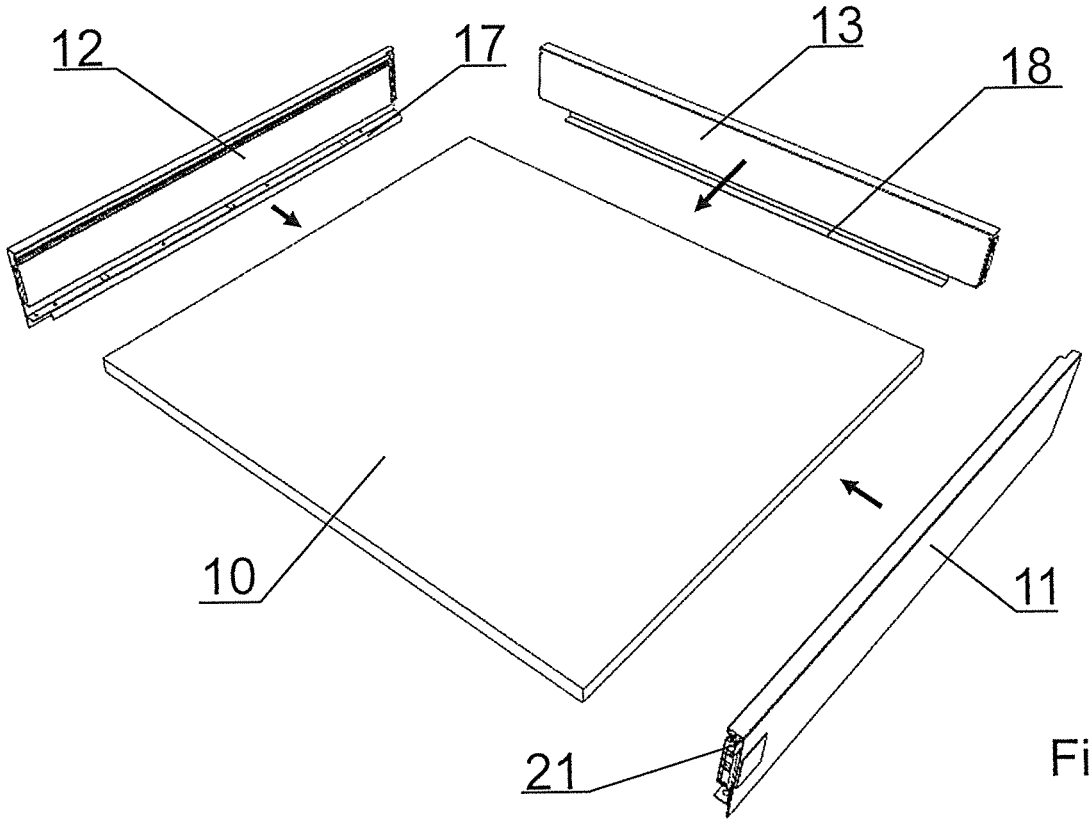
FIG. 3 shows the sheet-metal components for constructing the prefabricated unit, in the mounting position.

FIG. 3 shows the sheet-metal parts for the bottom panel 10, the two side walls 11 and 12, and the back wall 13; the side wall 12 and the back wall 13 have bent edges in the vicinity of their lower edge, which form a support or a receiving groove 17 or 18 for the bottom panel 10.

Figure 4:
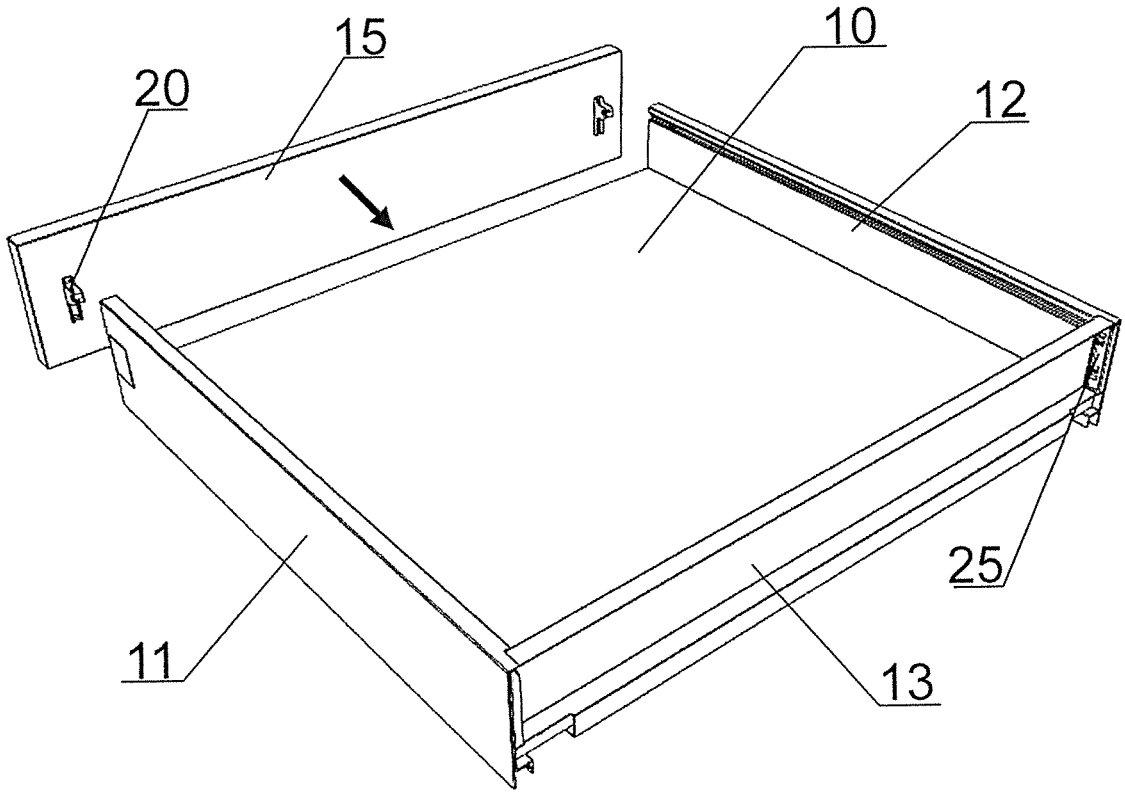
FIG. 4 shows the prefabricated unit with an attachable and re-detachable facing.

In FIG. 4, a facing 15 is assigned to the prefabricated sheet-metal unit; the facing closes the open face end of the prefabricated sheet-metal unit. This facing 15 on its back side has two fitting parts 20 which can be connected to and detached from fitting parts 21 built into the face end of the side walls 11 and 12. Furthermore, FIG. 4 shows a fitting part 25, mounted on the end of the side walls 11 and 12, which connects the back wall 13 to the side wall 12.

Figure 5:
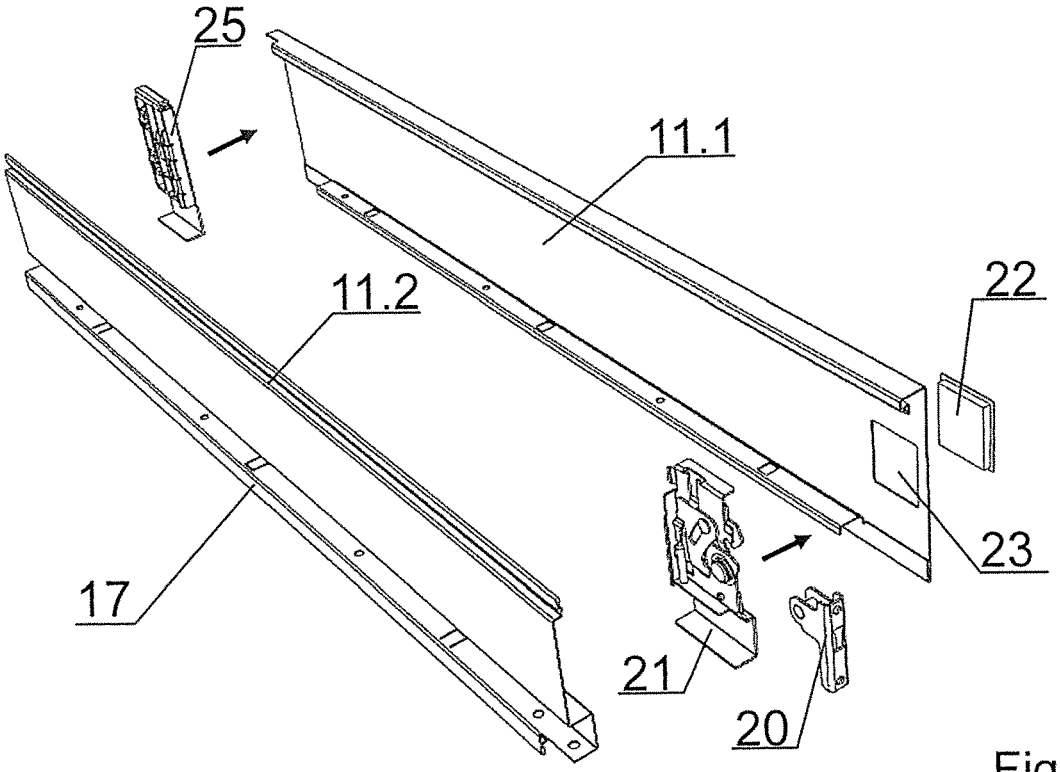
FIG. 5 shows the individual parts of a side wall in the mounting position.
Figure 6:
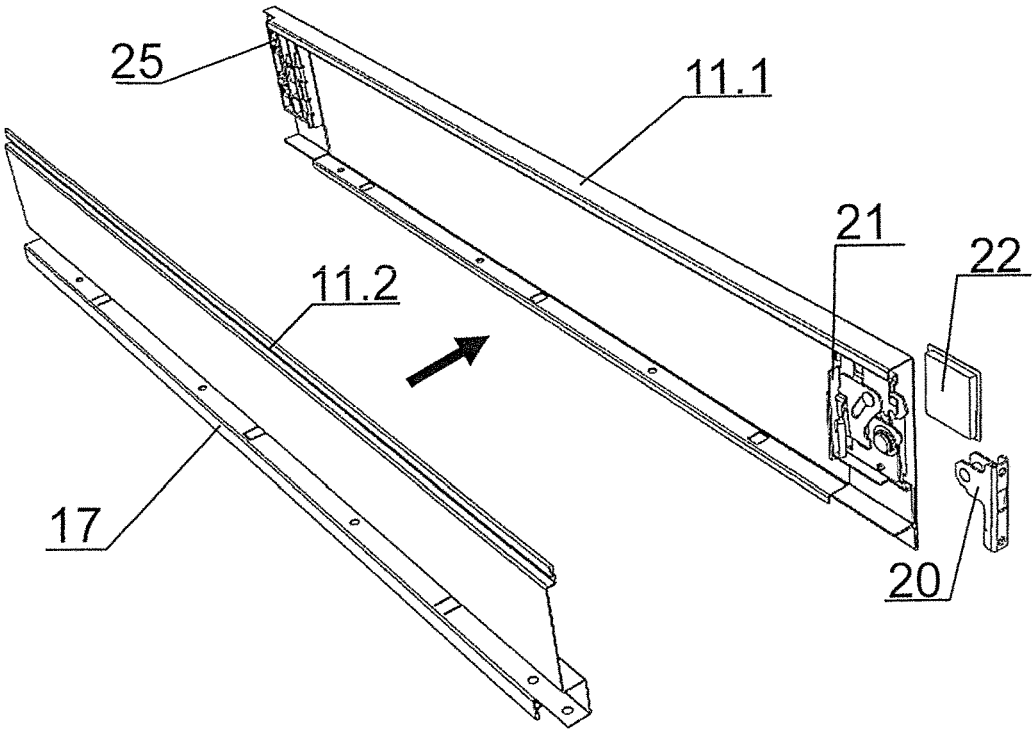
FIG. 6 shows the elements of FIG. 5 in an intermediate mounting position.

FIGS. 5 and 6 show that the side walls 11 and 12 comprise two bent side parts 11.1 and 11.2, which, on the face end of the fitting part 21, carry the fitting part 21 for receiving the fitting part 20 on the back side of the facing 15. The outer side part 11.1 is provided with a recess 23, which can be covered via a panel 22. Via a leaver within this recess 23, the locking of the two fitting parts 21 and 20 can then be tripped, so that the facing 15 can be detached again from the drawer. The insides of the inner side parts 11.1 are bent in the vicinity of the lower edge and embodied as supports or receiving grooves 17 or 18 for the bottom panel 10 of sheet metal or wood.

Figure 7:
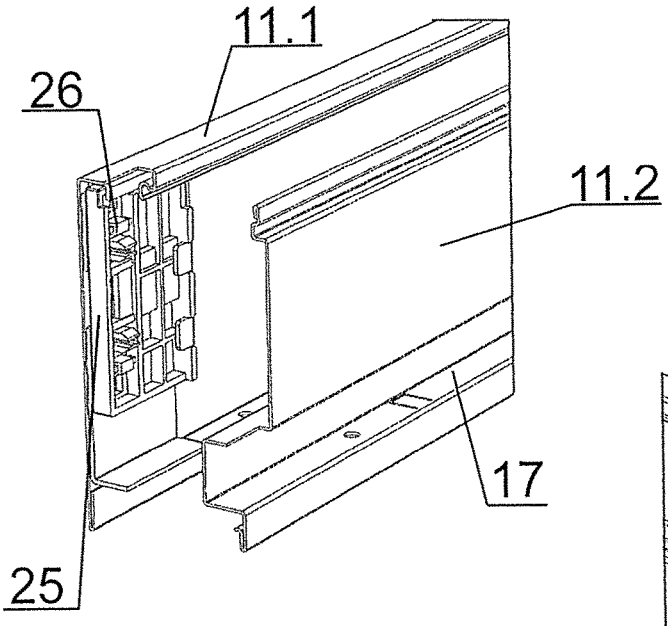
FIG. 7 shows the building in of the fitting part 25 on the end of the side of the side wall, which end is oriented toward the back wall.

FIG. 7 shows the building in of the fitting part 25 on the end of the side wall 11, which is oriented toward the back wall 13. The fitting part 25 is provided with two detent hooks 26, which protrude past the inside of the inner side part 11.1 and are capable of latching in detent receptacles 27 of the back wall 13 (FIGS. 12 and 13).

Figure 8:
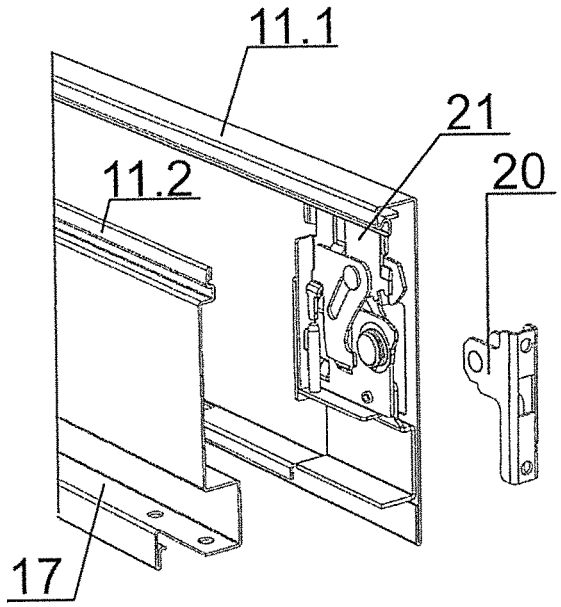
FIG. 8 shows the building in of the fitting part 21 on the face end of the side wall which end is oriented toward the facing.
Figure 9:
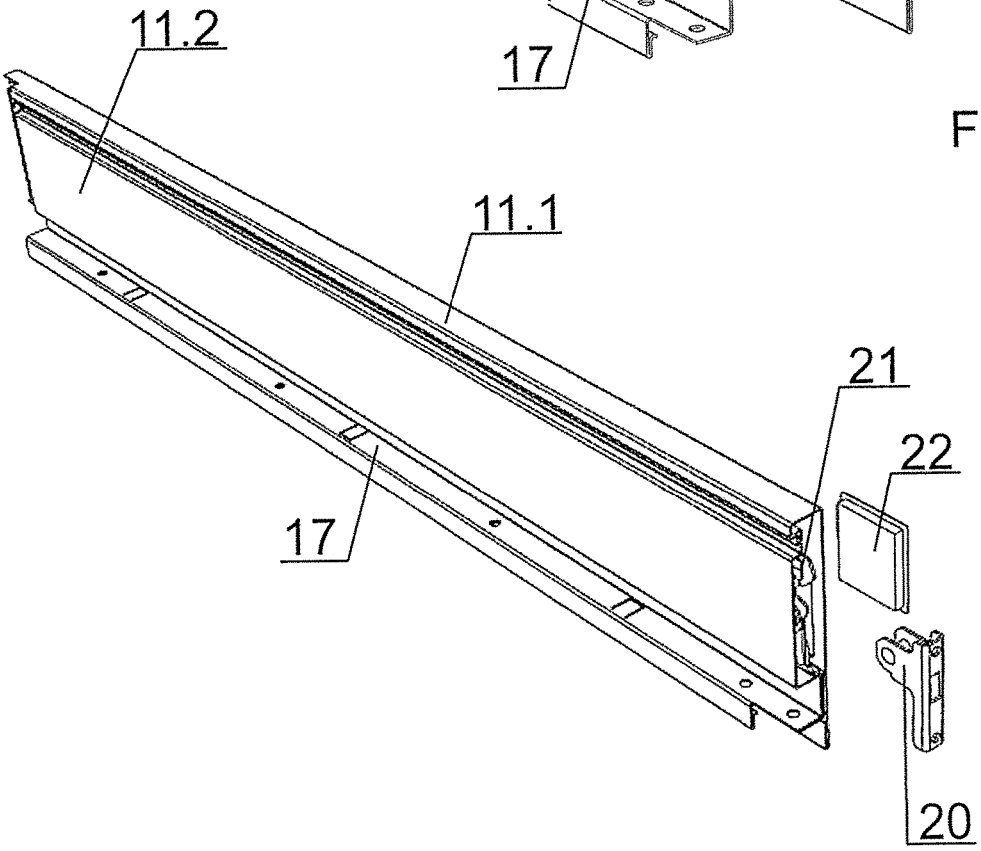
FIG. 9 shows the fitting part 21, which is built into a side wall, for the fitting part 20, which is secured to the back side of the facing.
Figure 10:
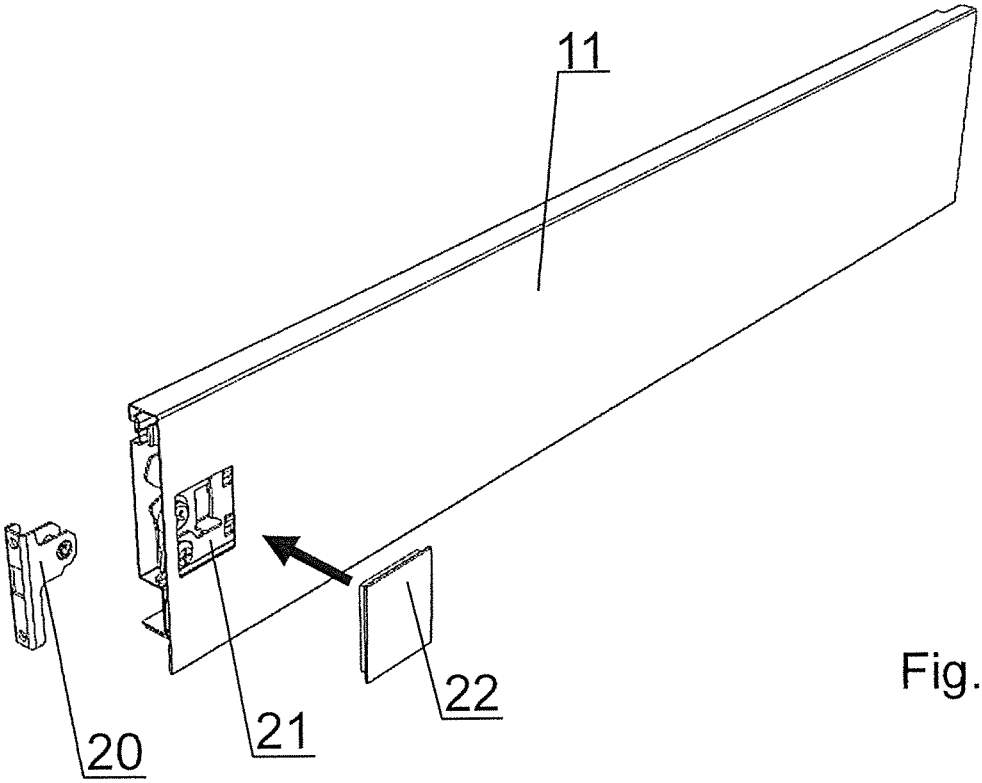
FIG. 10 shows the end of the side of the side wall oriented toward the facing.

FIG. 8 shows a fitting 21, which is built into the face end of the side wall 11 and can be latched to the fitting part 20 of the facing 15 and detached again from it. This fitting 21 forms a guide receptacle for a horizontal transverse pin of the fitting part 20 and is embodied such that it retracts the fitting part 20 and locks it. By means of a leaver within the recess 23 in the outer side part 11.1 of the side wall 11, this locking can be undone, so that the fitting part 20 is released and expelled. The recess 23 is covered by a panel 22 that can easily be detached from the outer side part 11.1, as shown in FIGS. 9 and 10. The expelled position of the fitting part 21 is locked again and is not released again until upon the connection of the facing 15 to the drawer.

Figure 11:
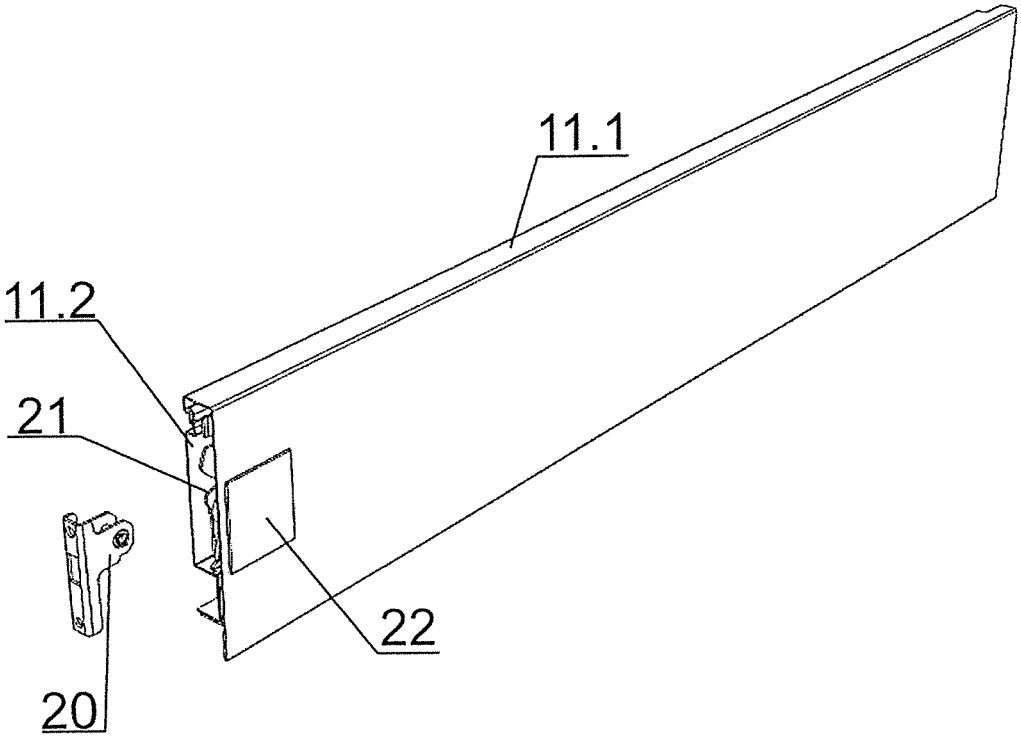
FIG. 11 shows the uncovered end of the side wall oriented toward the facing.

FIG. 11 shows the fitting part 21, built in between the two side parts 11.1 and 11.2 of the side wall 11 and covered by the panel 22, for the fitting part 20 on the back side of the facing 15.

Figure 12:
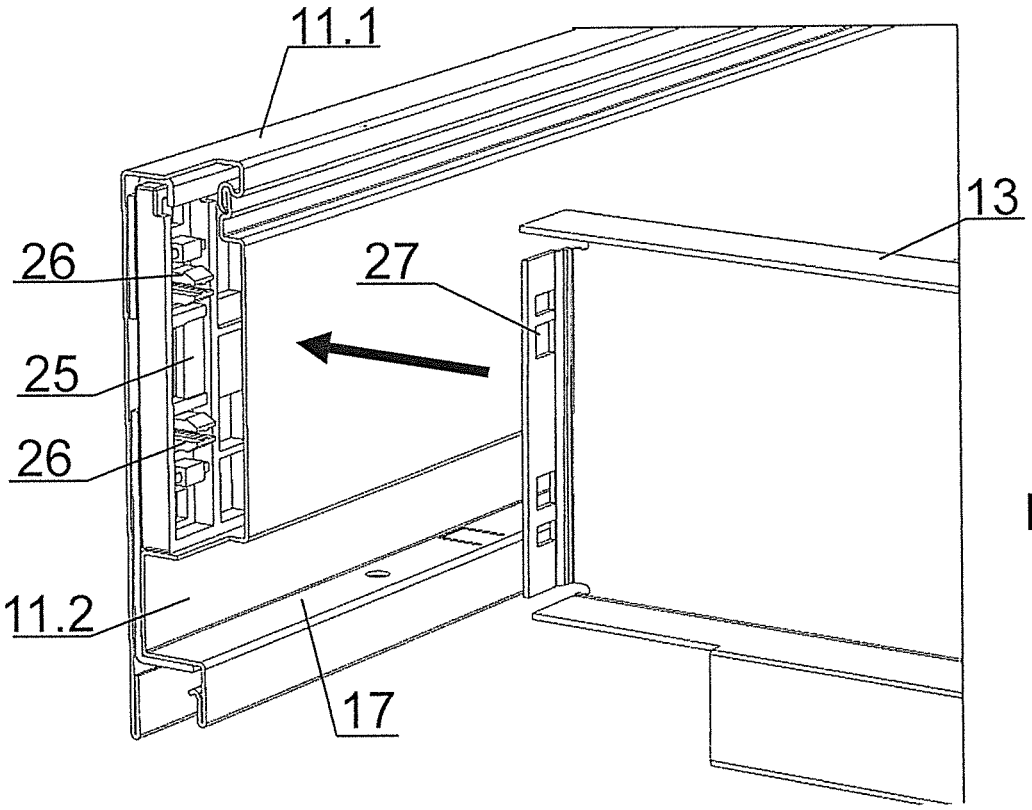
FIG. 12 shows one end of a side wall with a fitting part inserted, for connection to a back wall, in the mounting position.
Figure 13:
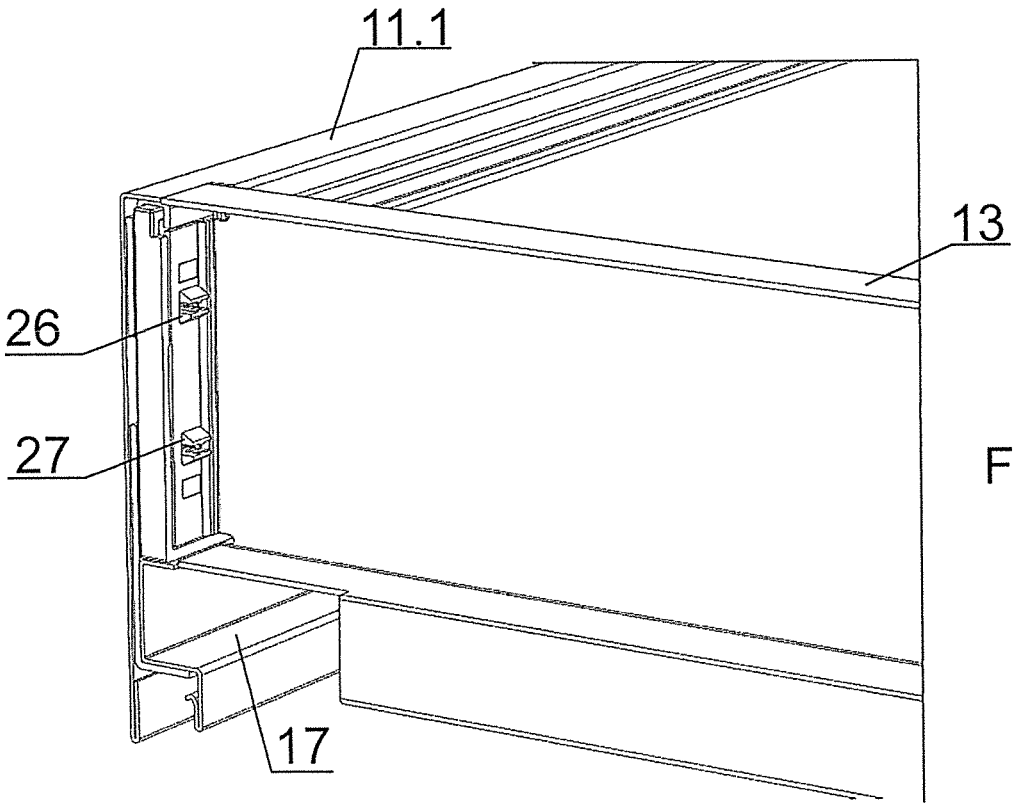
FIG. 13 shows the side wall and back wall of FIG. 12 in the latched connection position.

FIGS. 12 and 13 show how the back wall 13 can be connected firmly to the two side walls 11 and 12 of sheet metal. The inner side part 11.2 is recessed in the vicinity of the built-in fitting 25, so that the two detent hooks 26 protrude past the inside of the inner side part 11.1 and can latch directly into detent receptacles 27 of the back wall 13. The inner back wall part 13 is bent flush at the end, and the bent edge is provided with the detent receptacles 27.

Figure 14:
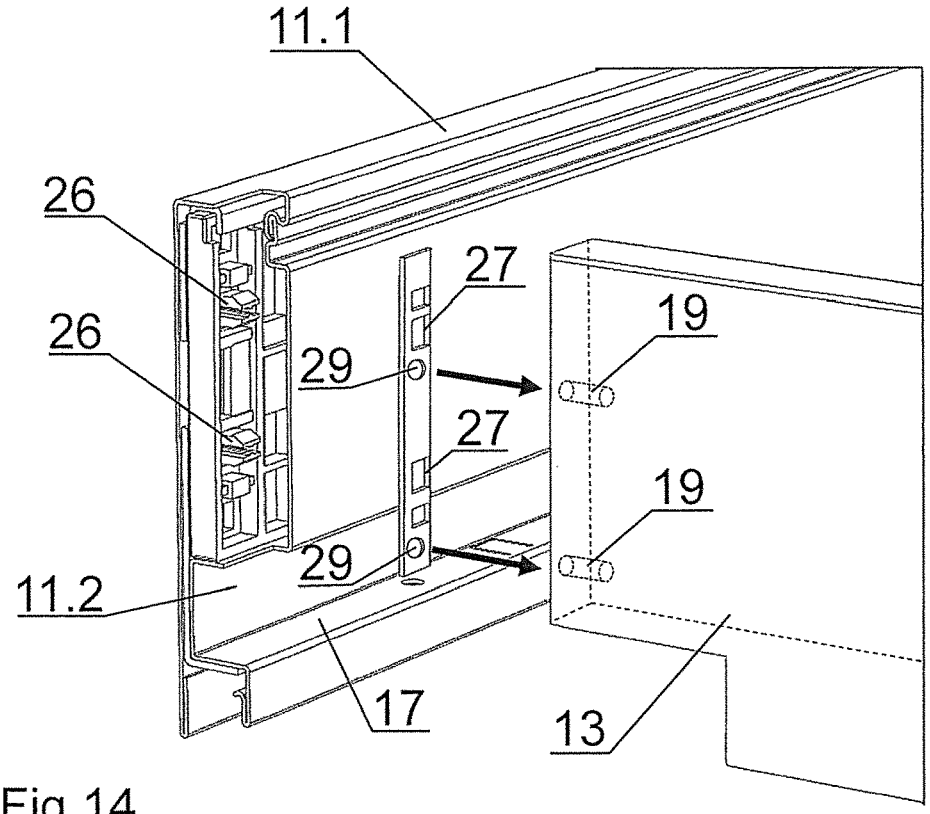
FIG. 14 shows one end of a side wall, made of wood, for connection to a back wall.
Figure 15:
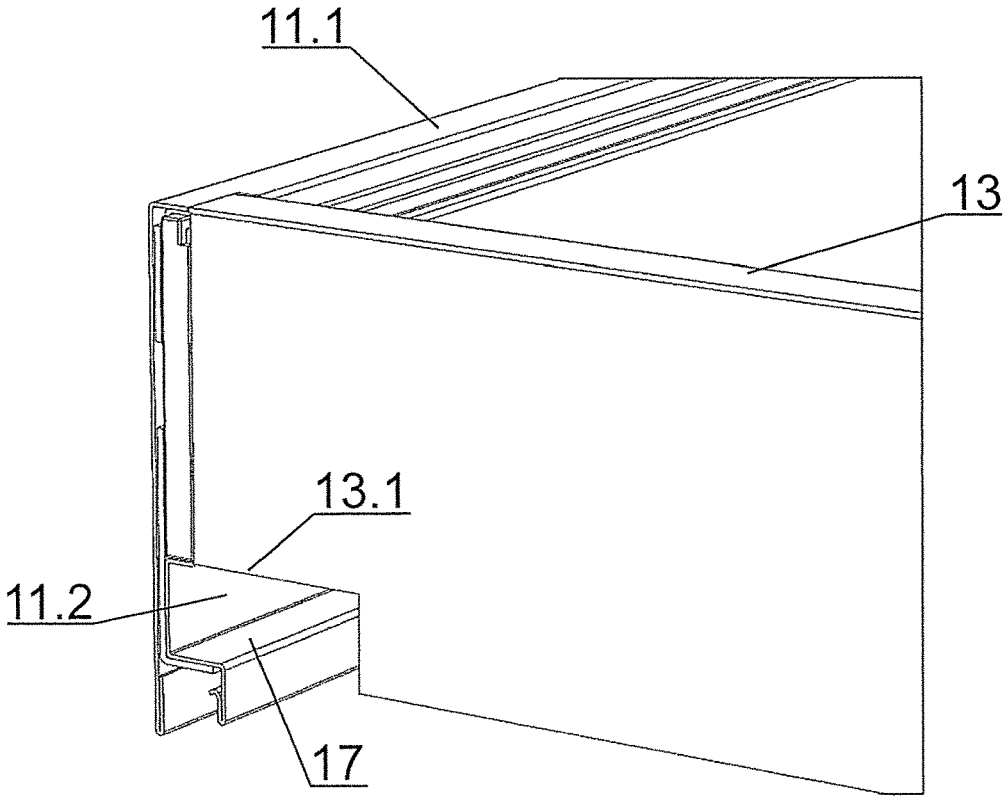
FIG. 15 shows one end of a side wall, made of wood, connected to the back wall.

FIGS. 14 and 15 show how the back wall 13 of wood can be connected to two side walls 11 and 12 of sheet metal. The face ends of the back wall 13 have bores 19 for connection bolts, which fix a sheet-metal strip, having the detent receptacles 27 and bores 29 for the fastening bolts, to the back wall 13. The detent springs 26 of the side walls 11 and 12 then latch by means of the strip into the detent receptacles 27 of the back wall 13.

From FIG. 15 it can be seen that the back wall, in the vicinity of the underside of the connection to the side wall 11, has a recess 13.1, so that the lower part of the inner side wall 11.2 having the support or receiving groove 17 does not interfere with the contact of the face end of the back wall with the outer and inner side walls 11.1 and 11.2.

The invention claimed is:

1. A drawer having a bottom panel (10), two side walls (11, 12), a back wall (13), and a facing (15), the drawer comprising:

the bottom panel (10), the two side walls (11, 12) and the back wall (13) comprising sheet metal; and the facing (15) comprising wood being connectable to sheet-metal parts;

the side walls (11, 12) and the back wall (13), in the vicinity of the lower edge, each of said side walls having a side inner groove (17) and said back wall having a rear inner groove (18), for receiving or supporting the bottom panel (10), and the facing (15) having a first fitting part (20) on its back side, which is connectable in a releasably latching configuration to a second fitting part (21) that is inserted into the side walls (11, 12) when the side walls (11, 12) face; and the ends of the side walls (11, 12) facing toward the back wall (13) have fitting parts (25), which are provided with detent hooks (26) and are latchable in detent receptacles (27) of a sheet-metal strip affixed to the back wall (13), wherein the second fitting part (21) is accessible via a recess (23) behind a panel of an outer side part (11.1 or 12.1) of the side walls (11 or 12), said second fitting being configured so that the locking of the first and second fitting parts (21 and 20) can be tripped via a leaver within said recess such that the facing (15) is expelled from the entryway of the fitting part (21) and from the side wall (11, 12) upon disassembly; and wherein said second fitting part being further configured so that said facing (15) is pulled against the face ends of the side walls (11, 12) upon assembly.

2. The drawer of claim 1, wherein the second fitting part (21) of the side walls (11, 12) is configured to be adjusted vertically and laterally in its position on the drawer.

3. The drawer of claim 1, wherein the side walls (11, 12), on the upper interior portion, have receiving grooves (17 or 18) for divider portions (15.1), which are oriented parallel to the facing (15) of the drawer.

4. The drawer of claim 1, wherein independently of the side walls (11, 12), the drawer is provided with guide rails (F), which are connected to the bottom panel (10) of the drawer.

5. The drawer of claim 1, wherein the side walls (11, 12) are each composed of two side parts (11.1, 11.2; 12.1, 12.2), and the second fitting part (21) on the face end facing toward the facing (15) are inserted between the two side parts (11.1, 11.2; 12.1, 12.2) and are connectable to the first fitting part (20) on the back side of the facing (15); and the inner side part (11.2) of the double-layered side wall (11, 12) has the side inner groove (17) for the bottom panel (10).

6. The drawer of claim 1, wherein the fitting part (25) connected to the end of the side walls (11, 12) and to the back wall (13) protrudes with detent hooks (26) from the inside of inner side parts (11.1 and 12.1, respectively) and is connectable and latchable to detent receptacles (27) of the sheet-metal strip affixed to the back wall (13).

7. The drawer of claim 1, wherein the side walls (11, 12) are composed of at least two side wall parts (11.1, 11.2 and 12.1, 12.2, respectively).

8. A drawer having a bottom panel (10), two side walls (11, 12), a back wall (13), and a facing (15), the drawer comprising:

the bottom panel (10) and the two side walls (11, 12) comprising sheet metal;

the back wall (13) and facing (15) comprising wood being connectable to sheet-metal parts;

the side walls (11, 12) and the back wall (13), in the vicinity of the lower edge, each of said side walls having a side inner groove (17) and said back wall having a rear inner groove (18), for receiving or supporting the bottom panel (10), and the facing (15) having a first fitting part (20) on its back side, which is connectable in a releasably latching configuration to a second fitting part (21) that is inserted into the side walls (11, 12) when the side walls (11, 12) face; and the ends of the side walls (11, 12) facing toward the back wall (13) have fitting parts (25), which are provided with detent hooks (26) and are latchable in detent receptacles (27) of a sheet-metal strip affixed to the back wall (13), the second fitting part (21) is accessible via a recess (23) behind a panel of an outer side part (11.1 or 12.1) of one of said side walls (11 or 12), said second fitting part being configured so that the locking of the first and second fitting parts (21 and 20) can be tripped via a leaver within said recess such that the facing (15) is expelled from the entryway of the second fitting part (21) and from the side wall (11, 12) upon disassembly, and said second fitting part being further configured so that said facing (15) is pulled against the face ends of the side walls (11, 12) upon assembly, wherein the back wall (13) of the drawer has bores (19) and the sheet-metal strip affixed to the back wall also having bores (29).

* * * * *